US006137210A

United States Patent [19]

Hsieh

[11] Patent Number: 6,137,210

[45] Date of Patent: Oct. 24, 2000

[54] HALOGEN LAMP WITH A HEAT INSULATING WASHER INTERPOSED BETWEEN A LAMP HOUSING AND A REFLECTOR

[75] Inventor: Duan-Cheng Hsieh, Taipei, Taiwan

[73] Assignee: Habitax Corporation, Taiwan

[21] Appl. No.: 09/036,304

[22] Filed: Mar. 6, 1998

[30] Foreign Application Priority Data

Sep. 19, 1997 [TW] Taiwan ..... 86216005

[51] Int. Cl.[7] ..... H01J 1/02

[52] U.S. Cl. ..... 313/47; 313/240

[58] Field of Search ..... 521/98, 60; 313/27, 313/47, 493, 634, 240; 362/296

[56] References Cited

U.S. PATENT DOCUMENTS 4,946,737 8/1990 Lindeman et al. ..... 521/54

*Primary Examiner*—Vip Patel
*Attorney, Agent, or Firm*—Foley & Lardner

[57] ABSTRACT

A halogen lamp includes a bowl-shaped lamp housing, a light source, a reflector which has the light source mounted thereon and which is disposed on the lamp housing, and a heat insulating washer which is made of a heat insulating elastic material. The heat insulating washer is interposed between an upper end rim of the lamp housing and an upper end rim of the reflector in such a manner that the washer contacts the lamp housing and the reflector and that the lamp housing is spaced apart from the reflector, thereby minimizing heat transfer from the reflector to the lamp housing.

4 Claims, 3 Drawing Sheets

HALOGEN LAMP WITH A HEAT INSULATING WASHER INTERPOSED BETWEEN A LAMP HOUSING AND A REFLECTOR

BACKGROUND OF THE INVENTION

1. Field of the Invention

This invention relates to a halogen lamp, more particularly to a halogen lamp which has a heat insulating washer that is interposed between a lamp housing and a reflector for minimizing heat transfer from the reflector to the lamp housing.

2. Description of the Related Art

Halogen lamps are popular because of their delicate appearance and strong light output. Generally, a halogen lamp operates with high power, e.g. 300 watts, so that, when the lamp tube is activated, a reflector that confines the lamp tube will reach a considerably high temperature which can burn flammable substances. Normally, in a conventional halogen lamp, because a lamp housing encloses and contacts the reflector, the lamp housing and the reflector are made of a heat resisting metal. As a result, a majority of the heat in the reflector is transferred to the lamp housing, thereby increasing the temperature at the outer surface of the lamp housing to above 90° C. Under this case, accidental contact with the lamp housing can result in burns. Similarly, flammable substances, such as paper or window curtain materials, may accidentally fall onto the lamp housing and burst into flames. The conventional halogen lamp is therefore unsafe and can run the risk of causing a fire in case no person is aware that something is burning on the halogen lamp. Furthermore, because the reflector and the lamp housing are made of metal, the reflector cannot be positioned stably in the lamp housing.

SUMMARY OF THE INVENTION

An object of this invention is to provide a halogen lamp with a heat insulating washer which is interposed between a reflector and a lamp housing, thereby minimizing heat transfer from the reflector to the lamp housing.

Another object of this invention is to provide a halogen lamp with an elastic washer which can form a firm joint between a reflector and a lamp housing.

According to this invention, a halogen lamp includes a bowl-shaped lamp housing, a light source, a reflector which has the light source mounted thereon and which is disposed on the lamp housing, and a heat insulating washer which is made of a heat insulating elastic material. The heat insulating washer is interposed between an upper end rim of the lamp housing and an upper end rim of the reflector in such a manner that the washer contacts the lamp housing and the reflector and that the lamp housing is spaced apart from the reflector, thereby minimizing heat transfer from the reflector to the lamp housing.

BRIEF DESCRIPTION OF THE DRAWINGS

Other features and advantages of this invention will become apparent in the following detailed description of the preferred embodiment of this invention with reference to the accompanying drawings in which.

DETAILED DESCRIPTION OF THE PREFERRED EMBODIMENT

Figure 1:
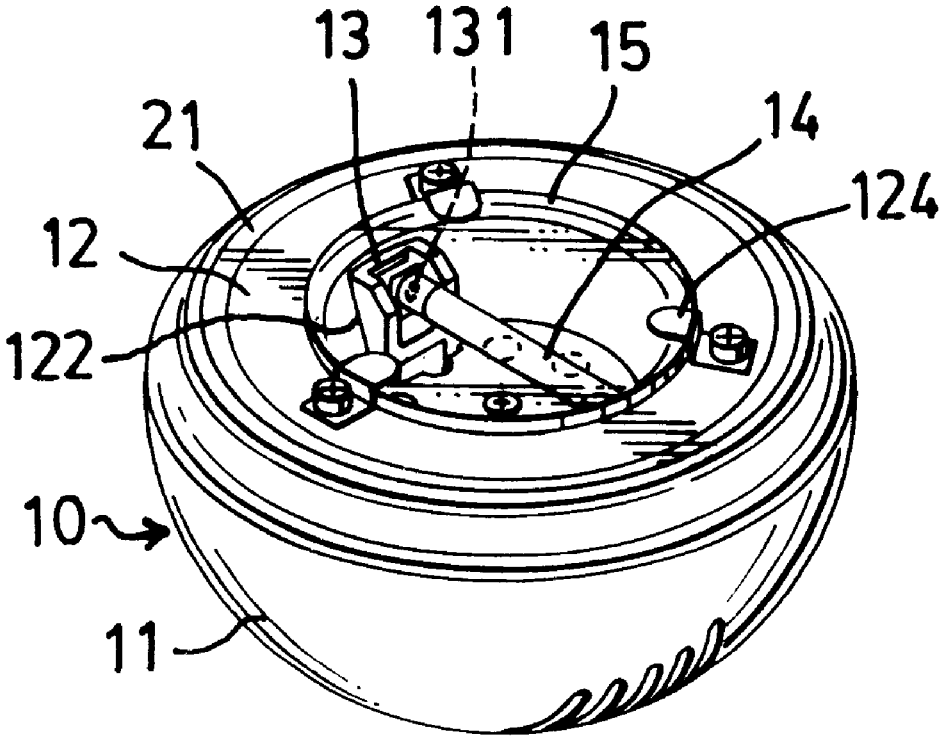
FIG. 1 is an assembled perspective view of the preferred embodiment of a halogen lamp according to this invention.

Referring to FIGS. 1 through 4, the preferred embodiment of a halogen lamp 10 according to this invention is shown to include a bowl-shaped lamp housing 11, a generally dish-shaped reflector 12, a mounting seat 13, a lamp tube 14 which acts as a light source, a transparent cover plate 15 and a heat insulating assembly 20. The lamp housing 11 and the reflector 12 are made of metal.

The lamp housing 11 has an upper end rim 111 and a plurality of slots 112 which are formed therethrough for facilitating heat dissipation. The upper end rim 111 has an upwardly and inwardly projecting periphery 113.

The reflector 12 is disposed on the lamp housing 11 and has an upper end rim 121 and two diametrically opposed insert holes 122 formed through a lower portion thereof. The upper end rim 121 has a horizontally, radially and outwardly projecting flange 123. The cover plate 15 is retained on the reflector 12 by means of three retaining plates 124 which are bolted to the reflector 12 in a known manner.

Figure 2:
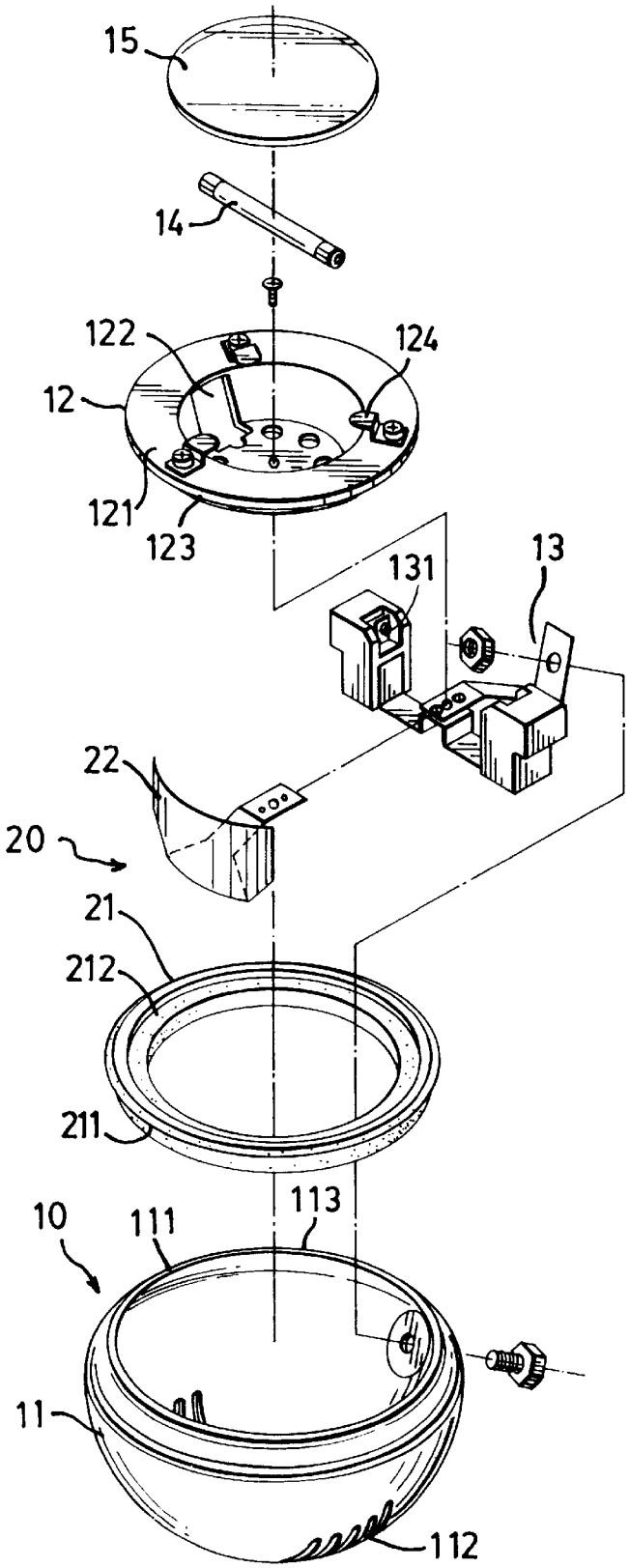
FIG. 2 is an exploded perspective view of the preferred embodiment.
Figure 3:
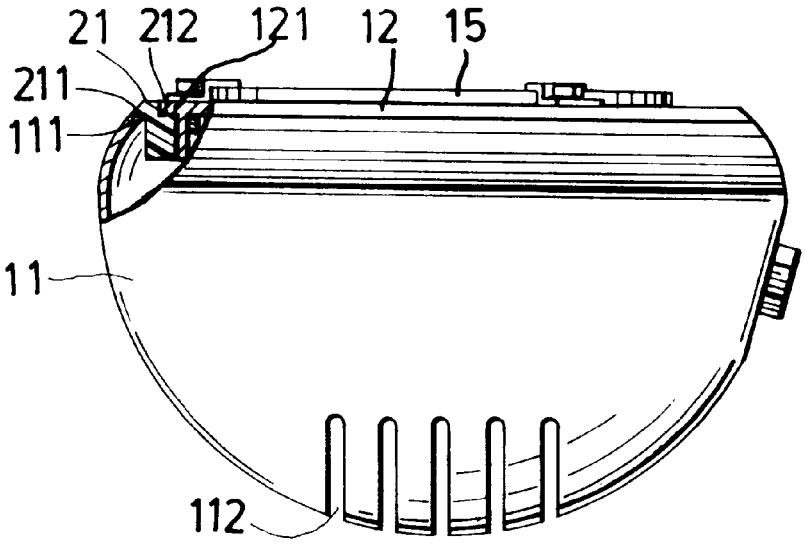
FIG. 3 is a schematic view illustrating location of a heat insulating washer relative to a reflector and a lamp housing of the preferred embodiment.
Figure 4:
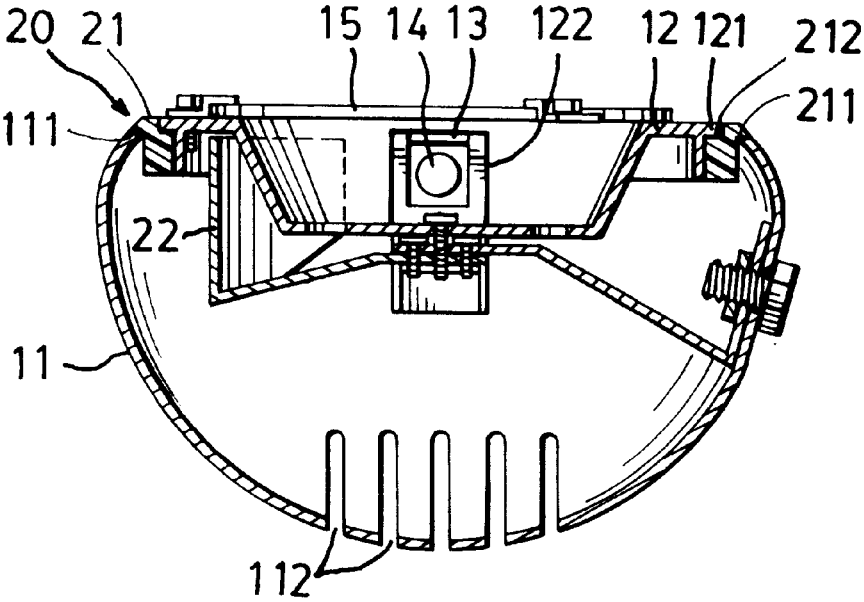
FIG. 4 is a schematic view illustrating location of a curved heat insulating plate relative to the reflector and the lamp housing.

The mounting seat 13 is bolted to the lamp housing 11 and has two tube mounting portions 131 (only one is shown in FIGS. 1 and 2) which extend partially into the reflector 12 through the insert holes 122 so as to mount the lamp tube 14 between and on the tube mounting portions 131.

The heat insulating assembly 20 consists of a heat insulating washer 21 and a curved heat insulating plate 22. The heat insulating washer 21 is made of a heat insulating elastic material, such as rubber, and is interposed between the upper end rims 111, 121 of the lamp housing 11 and the reflector 12. The washer 21 contacts the lamp housing 11 and the reflector 12. The lamp housing 11 is spaced apart from the reflector 12.

In this embodiment, the washer 21 has an outer periphery with an annular lower shoulder 211 formed on a lower end of the outer periphery of the washer 21, and an inner periphery with an annular upper shoulder 212 formed on an upper end of the inner periphery of the washer 21. The annular upper shoulder 212 contacts the flange 123 of the upper end rim 121 of the reflector 12 while the annular lower shoulder 211 contacts the periphery 113 of the upper end rim 111 of the lamp housing 11 so as to position the washer 21 stably between the lamp housing 11 and the reflector 12, thereby forming a firm joint between the lamp housing 11 and the reflector 12.

As illustrated, the curved heat insulating plate 22 is bolted to the seat 13 around the lamp tube 14, thereby diminishing heat transfer from the lamp tube 14 to the lamp housing 11. In this embodiment, the heat insulating plate is made of a metal.

With this invention thus explained. It is apparent that numerous modifications and variations can be made without departing from the spirit and scope of this invention. It is therefore intended that this invention be limited only as indicated in the appended claims.

I claim:

1. A halogen lamp comprising:

a bowl-shaped lamp housing having an upper end rim;

a light source;

a reflector which is disposed on said lamp housing and which has said light source mounted thereon, said reflector having an upper end rim; and a heat insulating washer made of a heat insulating elastic material and interposed between said upper end rims of said lamp housing and said reflector in such a manner that said washer contacts said lamp housing and said reflector and that said lamp housing is spaced apart from said reflector, thereby minimizing heat transfer from said reflector to said lamp housing.

2. A halogen lamp as claimed in claim 1, wherein said upper end rim of said reflector has a horizontally, radially and outwardly projecting flange, and said upper end rim of said lamp housing has an upwardly and inwardly projecting periphery, said washer having an inner periphery with an annular upper shoulder formed on an upper end of said inner periphery of said washer, and an outer periphery with an annular lower shoulder formed on a lower end of said outer periphery of said washer, said annular upper shoulder contacting said flange of said reflector and said annular lower shoulder contacting said upwardly and inwardly projecting periphery of said lamp housing so as to position said washer between said upper end rims of said reflector and said lamp housing.

3. A halogen lamp as claimed in claim 1, further comprising a curved heat insulating plate which is made of a heat insulating material and which is attached to said lamp housing around said light source, thereby diminishing heat transfer from said light source to said lamp housing.

4. A halogen lamp as claimed in claim 3, wherein said heat insulating plate is made of a metal.

* * * * *